US007946776B2

(12) United States Patent
Sonoda

(10) Patent No.: US 7,946,776 B2
(45) Date of Patent: May 24, 2011

(54) MEDIUM FEED CONTROL METHOD FOR PREVENTING OVERLAP-FEED OF RECORDING MEDIA

(75) Inventor: Masahiro Sonoda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 369 days.

(21) Appl. No.: 11/468,323

(22) Filed: Aug. 30, 2006

(65) Prior Publication Data

US 2007/0048060 A1 Mar. 1, 2007

(30) Foreign Application Priority Data

Sep. 1, 2005 (JP) ..... 2005-253244

(51) Int. Cl.
*B41J 13/02* (2006.01)
*B41J 13/08* (2006.01)
*B65H 3/52* (2006.01)

(52) U.S. Cl. ..... 400/636; 400/624; 400/625; 271/272; 271/273

(58) Field of Classification Search ..... 400/624–625, 400/636; 271/272–274, 270, 114
See application file for complete search history.

(56) References Cited

U.S. PATENT DOCUMENTS

| | | | | |
|---|---|---|---|---|
| 5,017,958 | A * | 5/1991 | Katoh | 355/408 |
| 5,435,538 | A * | 7/1995 | Billings et al. | 271/34 |
| 6,916,132 | B2 * | 7/2005 | Otsuka et al. | 400/621 |
| 2001/0035602 | A1 * | 11/2001 | Brown | 271/10.11 |

FOREIGN PATENT DOCUMENTS

| | | | |
|---|---|---|---|
| JP | 57-9652 | * | 1/1982 |
| JP | 07-276769 | * | 4/1994 |
| JP | 07-215517 | * | 8/1995 |
| JP | 09-142699 | * | 3/1997 |
| JP | 2002-046882 A | | 2/2002 |
| JP | 2003-072988 | * | 12/2003 |

* cited by examiner

*Primary Examiner* — Daniel J Colilla
*Assistant Examiner* — Marissa L Ferguson-Samreth
(74) *Attorney, Agent, or Firm* — Panitch Schwarze Belisario & Nadel LLP

(57) ABSTRACT

A sheet feeding procedure supplies recording media from a medium enclosing portion to a medium conveying path. An overlap-feed detecting procedure monitors a thickness of recording media supplied to the medium conveying path, thereby detecting the overlap-feed media. Sheet returning procedures (A) and (B) return the overlap-feed media into the medium enclosing portion when the overlap-feed media are detected. A looseness forming procedure applies rotational forces of different rotation speeds to upper and lower surfaces of the overlap-feed media during the medium returning procedure, thereby forming a looseness in the overlap-feed media. A medium re-feeding procedure supplies again the returned recording media to the medium conveying path from the medium enclosing portion. In the medium feed control, the overlap-feed can be further certainly recovered.

7 Claims, 14 Drawing Sheets

MEDIUM FEED CONTROL METHOD FOR PREVENTING OVERLAP-FEED OF RECORDING MEDIA

BACKGROUND OF THE INVENTION

1. Field of the Invention

The invention relates to a medium conveying apparatus, a medium feed control method, and an image forming apparatus using the control method and, more particularly, to a control method of preventing an overlap-feed of recording media and an image forming apparatus using the control method.

2. Related Background Art

In recent years, various image forming apparatuses have been developed and there are many kinds of recording media which are used in the image forming apparatuses. Therefore, development of a technique of a sheet feeding mechanism for feeding the optimum recording medium is also a significant subject (for example, refer to JP-A-2002-46882). Particularly, in an image forming apparatus for forming a full-color image, since image quality is improved if the image is recorded onto thick paper, it is demanded to accurately convey the recording media of various thicknesses. According to the related art, a medium thickness sensor for detecting the thickness of recording medium is arranged on a conveying path and, if the thickness detected by the medium thickness sensor exceeds a predetermined thickness, it is determined that an overlap-feed has occurred, so that the conveyance of the recording media is stopped. Further, the recording media whose conveyance has been stopped are temporarily returned into a paper feeding apparatus and supplied to the conveying path again. However, even if they were temporarily returned into the paper feeding apparatus and supplied to the conveying path again, it is often repetitively determined that the overlap-feed has occurred. In such a case, the recovery operation is repeated many times and the conveyance of the recording media is stopped (a jam error is displayed) eventually.

It is, therefore, a problem to be solved that in the conventional medium conveying apparatus, if the thickness detected by the medium thickness sensor exceeds the predetermined thickness, it is determined that the overlap-feed has occurred, so that the recording media are temporarily returned into the paper feeding apparatus and supplied to the conveying path again, and in such a case, the recovery operation is often repeated many times and the conveyance of the recording media is stopped (a jam error is displayed) eventually.

SUMMARY OF THE INVENTION

It is an object of the invention to provide a medium conveying apparatus and a medium feed control method for preventing an overlap-feed of recording media and an image forming apparatus using the control method.

According to the present invention, there is provided a medium feed control method of preventing an overlap-feed of recording media, comprising:

a medium feeding step whereby the recording media are supplied from a medium enclosing portion to a medium conveying path;

an overlap-feed detecting step whereby a thickness of the recording media which are supplied to the medium conveying path in the medium feeding step is monitored, thereby detecting the overlap-feed media;

a medium returning step whereby the overlap-feed media are returned into the medium enclosing portion when the overlap-feed media are detected in the overlap-feed detecting step;

a looseness forming step whereby different returning speeds are applied to upper and lower surfaces of the overlap-feed media on the way of the medium returning step, thereby forming a looseness in the overlap-feed media; and a medium re-feeding step whereby the recording media returned in the medium returning step are supplied again to the medium conveying path from the medium enclosing portion.

Moreover, in the medium feed control method, the rotational forces of the different returning speeds may be generated by rotating a feed roller and a retard roller in the opposite directions.

Moreover, in the medium feed control method, in the looseness forming step, the returning speeds applied to upper and lower surfaces of the overlap-feed media are controlled, and the looseness forming step includes a step to heighten one of the returning speeds with respect to another of the returning speeds and a step to lower the one of the returning speeds with respect to the another of the returning speeds.

Further, according to the present invention, there is provided a medium conveying apparatus for conveying media, comprising:

a paper feed roller which is rotated in a medium conveying direction and supplies the media;

a separating roller which is rotated in a direction opposite to the medium conveying direction and separates the media which are supplied by the paper feed roller;

a conveying roller which is arranged so as to face the separating roller, is rotated in the medium conveying direction, and conveys the media which are supplied by the paper feed roller in the medium conveying direction;

a discriminating unit which discriminates whether or not two or more of the media separated by the separating roller have been overlaid; and a control unit which, if it is determined by the discriminating unit that the two or more media have been overlaid, reverses the conveying roller in the direction opposite to the medium conveying direction at a rotation speed different from a rotation speed of the separating roller and, thereafter, rotates the conveying roller again in the medium conveying direction.

Furthermore, according to the present invention, there is provided an image forming apparatus comprising a medium conveying apparatus for conveying media, wherein the medium conveying apparatus includes:

a paper feed roller which is rotated in a medium conveying direction and supplies the media;

a separating roller which is rotated in a direction opposite to the medium conveying direction and separates the media which are supplied by the paper feed roller;

a conveying roller which is arranged so as to face the separating roller, is rotated in the medium conveying direction, and conveys the media which are supplied by the paper feed roller in the medium conveying direction;

a discriminating unit which discriminates whether or not two or more of the media separated by the separating roller have been overlaid; and a control unit which, if it is determined by the discriminating unit that the two or more media have been overlaid, reverses the conveying roller in the direction opposite to the medium conveying direction at a rotation speed different from a rotation speed of the separating roller and, thereafter, rotates the conveying roller again in the medium conveying direction.

When the overlap-feed media are detected, since rotational forces of different rotation speeds are applied to the upper and lower surfaces of the overlap-feed media on the way of the medium returning procedure, a looseness occurs in the overlap-feed media and the overlap-feed media are temporarily separated. Thus, such an effect that when the recording media are fed again, they are hardly overlap-fed is obtained.

Other features and advantages of the present invention will be apparent from the following description taken in conjunction with the accompanying drawings, in which like reference characters designate the same or similar parts throughout the figures thereof.

DETAILED DESCRIPTION OF THE PREFERRED EMBODIMENTS

According to the invention, a looseness forming procedure with a construction which is largely different from the conventional medium feed control method is constructed by a computer control procedure which is activated when a CPU executes a predetermined control program which has previously been stored in a ROM.

Embodiment 1

First, a construction of an image forming apparatus to which the invention is applied and an outline of its operation will be described.

Figure 1:
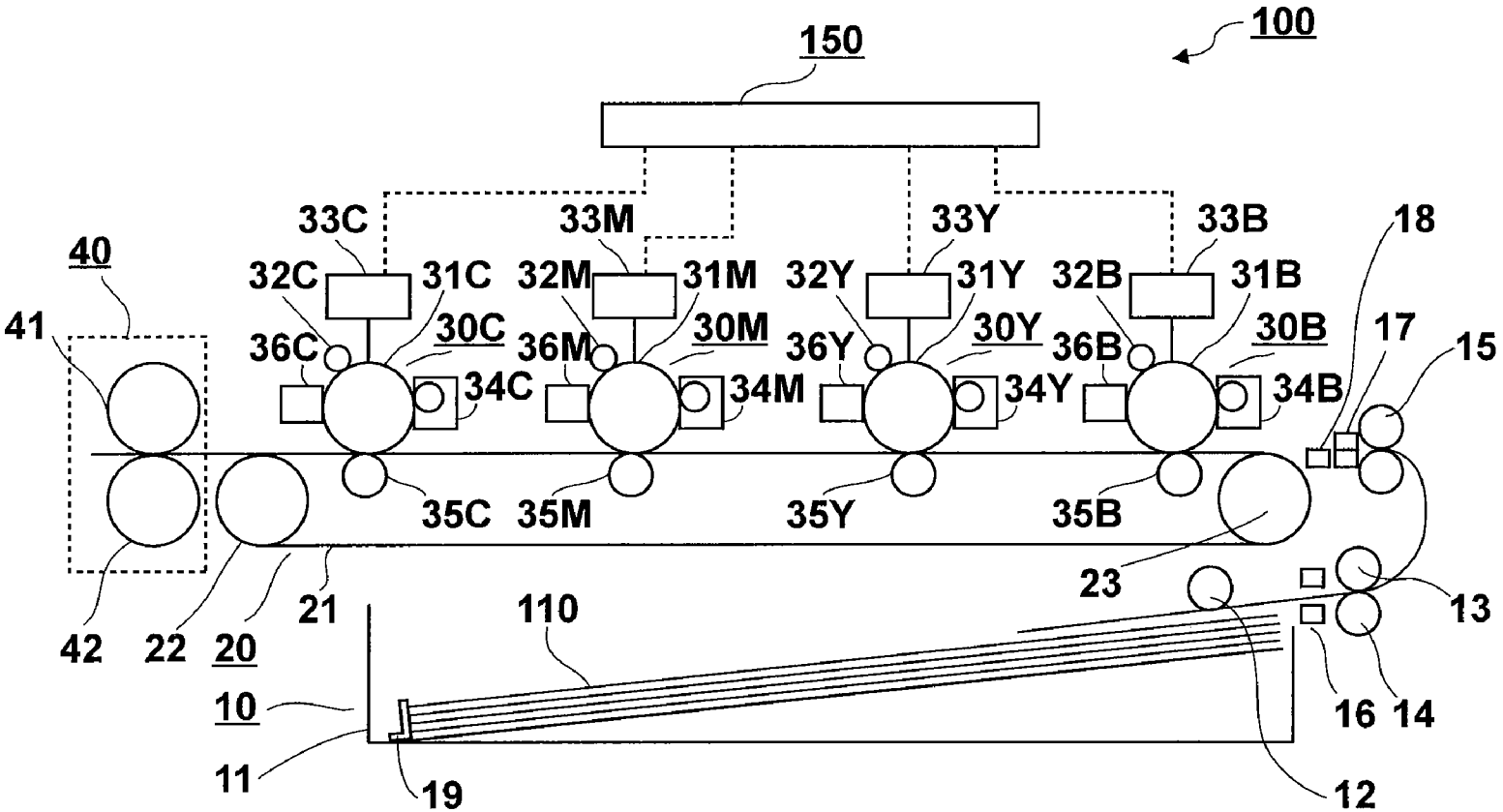
FIG. 1 is a schematic side elevational view of an image forming apparatus to which the invention is applied.

FIG. 1 is a schematic side elevational view of the image forming apparatus to which the invention is applied.

As shown in the diagram, an image forming apparatus 100 to which the invention is applied has the following component elements which are arranged in a casing of a main body of the apparatus: a paper feeding unit 10; a conveying belt mechanism unit 20; an image forming unit 30C of cyan (C); an image forming unit 30M of magenta (M); an image forming unit 30Y of yellow (Y); an image forming unit 30B of black (B); a fixing unit 40; and a control unit 150.

In the paper feeding unit 10, a bundle of sheets of recording paper 110 which are laminated in a paper feed cassette 11 are picked up one by one from a recording paper guide 19 by a pickup roller 12 and fed to a looseness detecting sensor 16. When the looseness detecting sensor 16 detects the recording paper 110, a feed roller 13 and a retard roller 14 start rotation, thereby advancing the recording paper 110 to a resist roller pair 15. After the resist roller pair 15 corrected an oblique motion of the recording paper 110, it further advances the recording paper 110 to a front edge sensor 18. When a front edge of the recording paper 110 reaches the front edge sensor 18 and the arrival is detected by the sensor 18, the paper feeding operation is temporarily stopped and a thickness of recording paper 110 is measured by a paper thickness sensor 17 arranged between the resist roller pair 15 and the sensor 18.

A measurement result is sent to the control unit 150. Various conditions which are optimum to the measured thickness of recording paper 110, for example, various conditions regarding the charging, development, transfer, and fixing when an image is formed are determined. When the optimum various conditions are determined, the resist roller pair 15 is rotated and the recording paper 110 is fed to the conveying belt mechanism unit 20 at predetermined timing.

The conveying belt mechanism unit 20 has a conveying belt 21, a driving roller 22, and a driven roller 23. The conveying belt 21 is suspended between the driving roller 22 and the driven roller 23. The driving roller 22 is rotated by a driving mechanism such as a driving motor (not shown) and the like under control of the control unit 150. The conveying belt 21 sequentially conveys the recording paper 110 fed from the paper feeding unit 10 to the image forming units (30C, 30M, 30Y, 30B) of the respective colors. A black toner image, a yellow toner image, a magenta toner image, and a cyan toner image of the respective colors are sequentially formed onto the conveyed recording paper 110.

In the image forming units (30C, 30M, 30Y, 30B) of the respective colors, photosensitive materials (31C, 31M, 31Y, 31B) are arranged at regular intervals along the conveying direction of the conveying belt 21. The following component elements are arranged around the photosensitive materials (31C, 31M, 31Y, 31B): charging units (32C, 32M, 32Y, 32B); exposing units (33C, 33M, 33Y, 33B); developing units (34C, 34M, 34Y, 34B); transfer units (35C, 35M, 35Y, 35B); cleaning units (36C, 36M, 36Y, 36B); charge removing units (not shown); and the like.

The image forming units (30C, 30M, 30Y, 30B) of the respective colors are rotated by a driving mechanism (not shown). The surfaces of the photosensitive materials (31C, 31M, 31Y, 31B) are uniformly charged by the charging units (32C, 32M, 32Y, 32B). Images based on image data are irradiated onto the charged surfaces by the exposing units (33C, 33M, 33Y, 33B), so that electrostatic latent images are formed. Four kinds of toner of cyan (C), magenta (M), yellow (Y), and black (B) are deposited onto the electrostatic latent images and toner images of the respective colors are formed.

Further, the toner images of the respective colors of cyan (C), magenta (M), yellow (Y), and black (B) on the surfaces of the photosensitive materials (31C, 31M, 31Y, 31B) are sequentially laminated and transferred onto the recording paper 110 conveyed between the conveying belt 21 and the photosensitive materials (31C, 31M, 31Y, 31B) by the transfer units (35C, 35M, 35Y, 35B) arranged to the back surface of the conveying belt 21 by a transfer voltage which is determined on the basis of the thickness of recording paper 110 detected by the paper thickness sensor 17.

The remaining toner of the photosensitive materials (31C, 31M, 31Y, 31B) after completion of the transfer of the toner images are removed by the cleaning units (36C, 36M, 36Y, 36B) and the charges on the photosensitive materials are removed by the charge removing units (not shown). After that, the photosensitive materials are charged again by the charging units (32C, 32M, 32Y, 32B) and the subsequent image forming operation is executed.

In the state where the recording paper 110 to which the toner images of the respective colors of cyan (C), magenta (M), yellow (Y), and black (B) had been transferred has electrostatically been adsorbed to the conveying belt 21, the recording paper 110 is further conveyed by the conveying belt 21, separated from the conveying belt 21, and conveyed to the fixing unit 40.

The fixing unit 40 has a fixing roller 41 and a pressing roller 42. The fixing roller 41 and the pressing roller 42 are pressed by a predetermined pressing force and rotated by the driving motor (not shown). The fixing roller 41 is heated and controlled by an internal heater to an optimum temperature that is decided on the basis of the detection result of the paper thickness sensor 17.

On the basis of the heating control as mentioned above, the recording paper 110 to which the toner images of the respective colors of cyan (C), magenta (M), yellow (Y), and black (B) have been transferred from the conveying belt 21 is heated and pressed by the fixing roller 41 and the pressing roller 42 and each toner image is fixed onto the recording paper 110. The recording paper 110 to which the toner images have been fixed is ejected onto a delivery tray (not shown) by a paper ejecting roller pair (not shown).

The control unit 150 is a portion to control the whole image forming apparatus. Explanation will be described in detail hereinbelow with respect only to a medium feed control method in the image forming apparatus of the embodiment.

Figure 2:
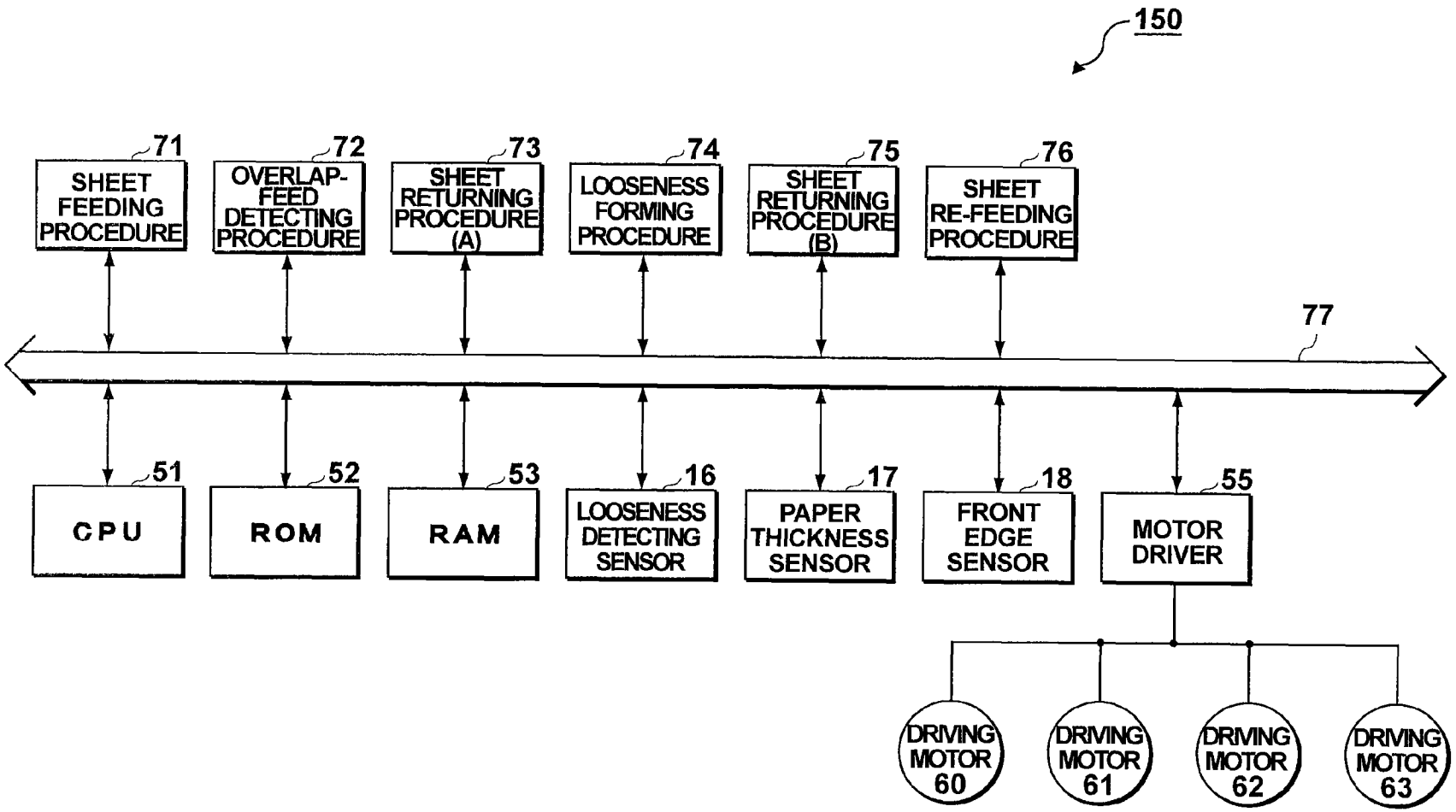
FIG. 2 is a block diagram showing a construction of medium feed control in the embodiment 1.

FIG. 2 is a block diagram showing a construction of the medium feed control in the embodiment 1.

As shown in the diagram, the control unit 150 to execute the medium feed control in the image forming apparatus of the embodiment has: a CPU 51; a ROM 52; a RAM 53; the looseness detecting sensor 16; the paper thickness sensor 17; the front edge sensor 18; a motor driver 55; a sheet feeding procedure 71; an overlap-feed detecting procedure 72; a sheet returning procedure (A) 73; a looseness forming procedure 74; a sheet returning procedure (B) 75; a sheet re-feeding procedure 76; and a common bus 77.

The CPU 51 is a microprocessor to control the whole apparatus. In the embodiment, particularly, the CPU 51 is a portion for activating the sheet feeding procedure 71, overlap-feed detecting procedure 72, sheet returning procedure (A) 73, looseness forming procedure 74, sheet returning procedure (B) 75, and sheet re-feeding procedure 76 by a method whereby the CPU 51 executes a predetermined control program which has previously been stored in the ROM 52.

The ROM 52 is a read only memory in which the control program for activating the sheet feeding procedure 71, overlap-feed detecting procedure 72, sheet returning procedure (A) 73, looseness forming procedure 74, sheet returning procedure (B) 75, and sheet re-feeding procedure 76 by the method whereby the CPU 51 executes such a program has previously been stored. Control data necessary for the control has also previously been stored in the ROM 52.

The RAM 53 is a random access memory for providing an arithmetic operating area necessary when the CPU 51 executes the control program.

The looseness detecting sensor 16 has two contact points. At one of the two contact points, the looseness detecting sensor 16 detects that the recording paper 110 has been supplied to the conveying path. At the other contact point, the looseness detecting sensor 16 detects an upward looseness of the recording paper 110 which is formed by the looseness forming procedure 74, which will be explained hereinafter.

The paper thickness sensor 17 is a sensor which is arranged between the resist roller pair 15 (FIG. 1) and the front edge sensor 18 and measures the thickness of recording paper 110.

The front edge sensor 18 is arranged just after the downstream side of the paper thickness sensor 17 (FIG. 1) and is a sensor for detecting the arrival of the recording paper 110.

The motor driver 55 is a portion for driving each of driving motors 60, 61, 62, and 63 under the control of the sheet feeding procedure 71, overlap-feed detecting procedure 72, sheet returning procedure (A) 73, looseness forming procedure 74, sheet returning procedure (B) 75, and sheet re-feeding procedure 76 by the CPU 51.

The sheet feeding procedure 71, overlap-feed detecting procedure 72, sheet returning procedure (A) 73, looseness forming procedure 74, sheet returning procedure (B) 75, and sheet re-feeding procedure 76 are control procedures for the medium feed control in the embodiment and are computer control procedures which are activated by the method whereby the CPU 51 executes the predetermined control program which has previously been stored in the ROM 52. The operation of the image forming apparatus of the embodiment is limited only to the medium feed control method, divided into nine processing steps, and will be explained hereinbelow together with an explanation of each of the control procedures.

Figure 3:
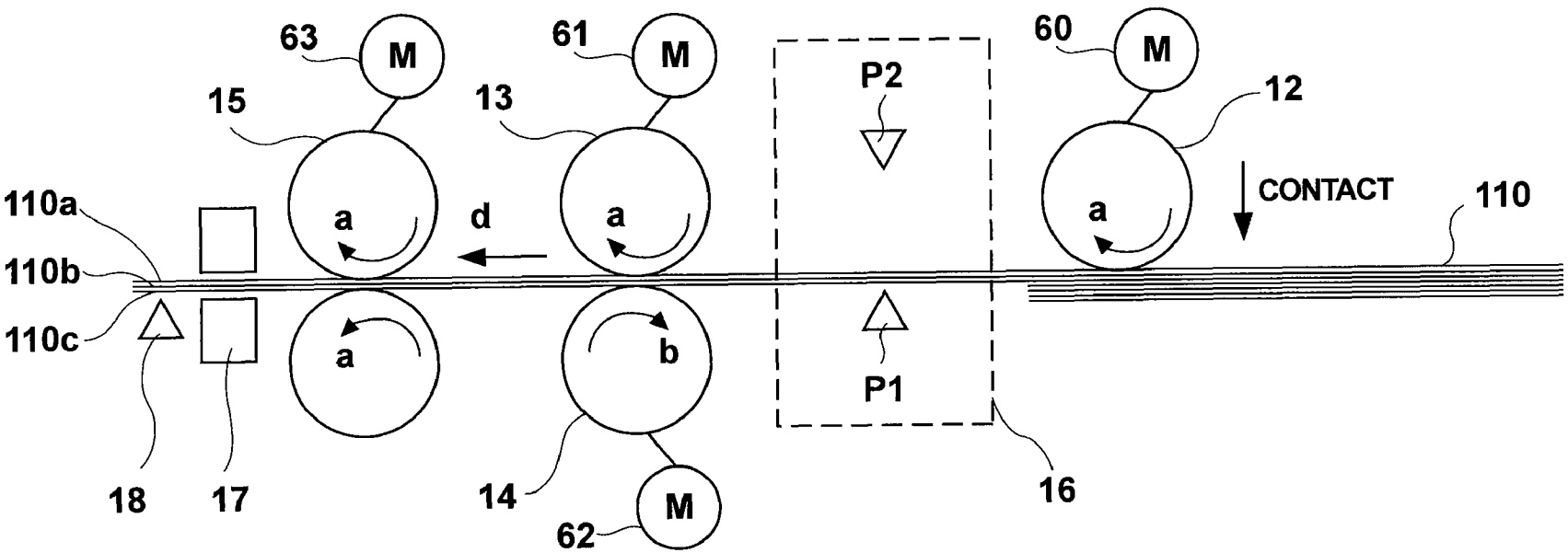
FIG. 3 is an explanatory diagram of a sheet feeding procedure and an overlap-feed detecting procedure in the embodiment 1.

FIG. 3 is an explanatory diagram of the sheet feeding procedure and the overlap-feed detecting procedure in the embodiment 1.

Step S1-1:

Under the control of the sheet feeding procedure 71 (FIG. 2), the pickup roller 12 is come into contact with a top one of the bundle of recording paper 110 enclosed in the paper feed cassette 11 (FIG. 1). At the same time, under the control of the sheet feeding procedure 71 (FIG. 2), the motor driver 55 (FIG. 2) forwardly rotates the driving motor 60, thereby rotating the pickup roller 12 in the direction shown by an arrow (a).

Step S1-2:

When the recording paper 110 is fed out by the pickup roller 12 and come into contact with a contact point P1 of the looseness detecting sensor 16, the motor driver 55 (FIG. 2) forwardly 25 rotates the driving motor 61 under the control of the sheet feeding procedure 71 (FIG. 2), thereby rotating the feed roller 13 in the direction of the arrow (a). At the same time, the motor driver 55 (FIG. 2) reversely rotates the driving motor 62, thereby rotating the retard roller 14 in the direction shown by an arrow (b). Thus, the separating operation of the recording paper 110 fed out by the pickup roller 12 is executed.

Step S1-3:

After the advance of the front edge portion of the recording paper 110 was retarded in a nip portion of the resist roller pair 15 and the oblique motion of the paper was corrected, the motor driver 55 (FIG. 2) forwardly rotates the driving motor 63, thereby rotating the resist roller pair 15 in the direction of the arrow (a) and feeding the recording paper 110.

Step S1-4:

When the front edge portion of the recording paper 110 reaches the front edge sensor 18, the overlap-feed detecting procedure 72 (FIG. 2) is activated. Under the control of the overlap-feed detecting procedure 72 (FIG. 2), the motor driver 55 (FIG. 2) temporarily stops the driving motors 60, 61, 62, and 63. At this time, the overlap-feed detecting procedure 72 (FIG. 2) controls the paper thickness sensor 17 so as to measure a medium thickness $\alpha n$ of the recording paper 110. The overlap-feed detecting procedure 72 (FIG. 2) compares the medium thickness $\alpha n$ with a reference medium thickness $\alpha 0$ of the recording medium which has previously been stored in the ROM 52 (FIG. 2). If a value of an is equal to or more than two times as large as a value of $\alpha 0$, it is determined that the overlap-feed has occurred. When this overlap-feed determination is made, the sheet returning procedure (A) 73 (FIG. 2) is activated.

Figure 4:
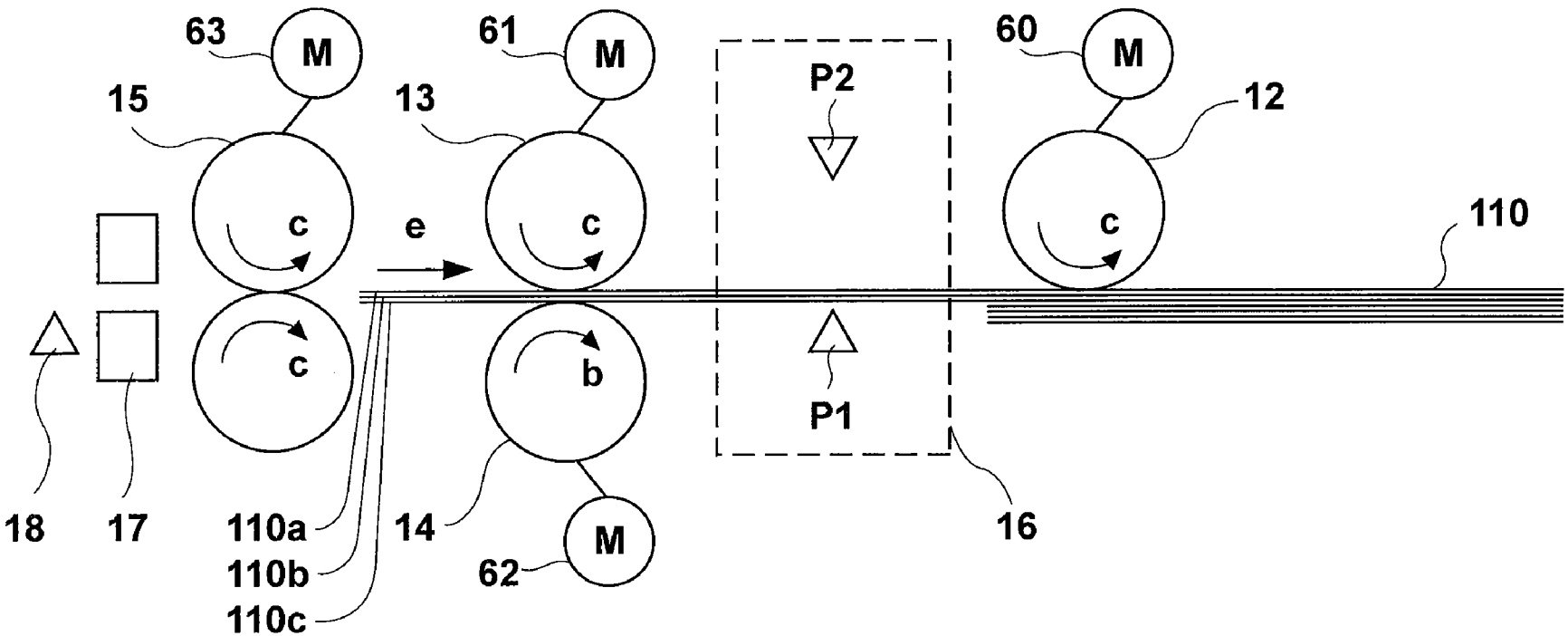
FIG. 4 is an explanatory diagram of a sheet returning procedure (A) in the embodiment 1.

FIG. 4 is an explanatory diagram of the sheet returning procedure (A) in the embodiment 1.

Step S1-5:

Under the control of the sheet returning procedure (A) 73 (FIG. 2), the sheets of recording paper 110 are returned in the direction shown by an arrow (e). To return the recording paper 110 in the direction of the arrow (e), under the control of the sheet returning procedure (A) 73 (FIG. 2), the motor driver 55 (FIG. 2) reversely rotates the driving motors 60, 61, 62, and 63. When the sheets of recording paper 110*a*, 110*b*, and 110*c* which are being overlap-fed escape from the resist roller pair 15, the looseness forming procedure 74 (FIG. 2) is activated.

Figure 5:
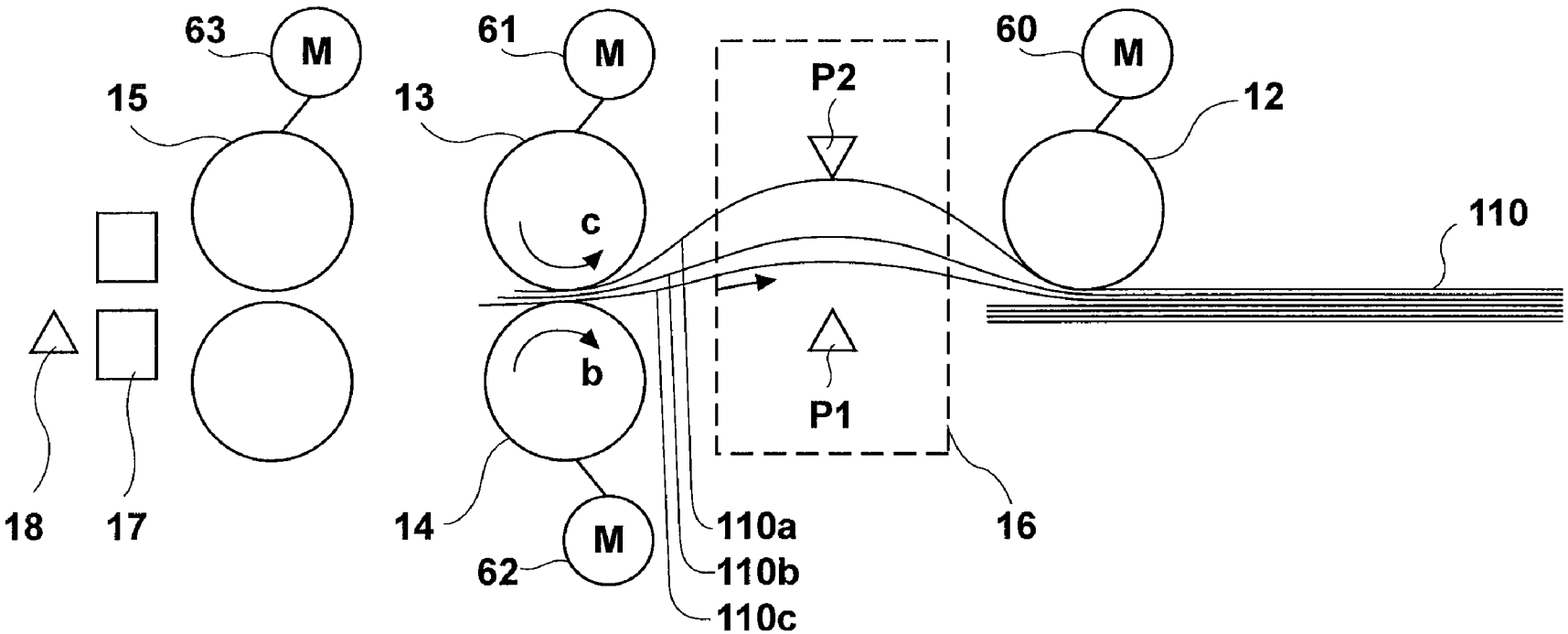
FIG. 5 is an explanatory diagram of a looseness forming procedure in the embodiment 1.

FIG. 5 is an explanatory diagram of the looseness forming procedure in the embodiment 1.

Step S1-6:

Under the control of the looseness forming procedure 74 (FIG. 2), the motor driver 55 (FIG. 2) stops the driving motors 60 and 63, thereby stopping the pickup roller 12 and the resist roller pair 15. Under the control of the looseness forming procedure 74 (FIG. 2), the motor driver 55 (FIG. 2) drives the driving motors 61 and 62, thereby allowing the feed roller 13 and the retard roller 14 to continue the rotation in the directions shown by arrows (c and b) until the recording paper 110*a* is come into contact with a contact point P2 of the looseness detecting sensor 16. In this instance, a rotation speed (i.e. returning speed) V13 of the feed roller 13 and a rotation speed (i.e. returning speed) V14 of the retard roller 14 are set so as to maintain a relation of (V13>V14). By this setting, a looseness is formed in each of the recording paper 110*a*, 110*b*, and 110*c* as shown in the diagram. Thus, air layers are formed among the sheets of recording paper 110*a*, 110*b*, and 110*c* and they are easily separated. When the recording paper 110*a* is come into contact with the contact point P2 of the looseness detecting sensor 16, the sheet returning procedure (B) 75 is activated.

Figure 6:
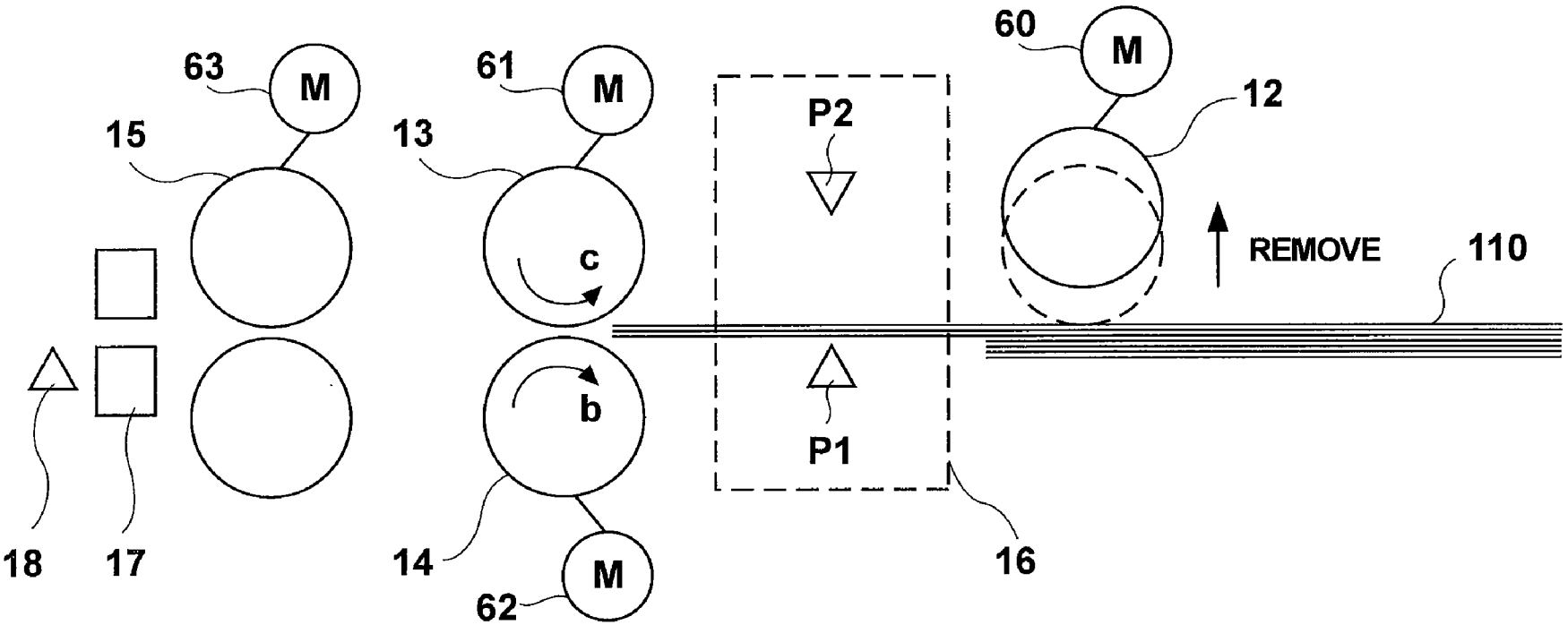
FIG. 6 is an explanatory diagram of a sheet returning procedure (B) in the embodiment 1.

FIG. 6 is an explanatory diagram of the sheet returning procedure (B) in the embodiment 1.

Step S1-7:

Under the control of the sheet returning procedure (B) 75 (FIG. 2), the pickup roller 12 is removed from the top one of the bundle of recording paper 110 enclosed in the paper feed cassette 11 (FIG. 1). Under the control of the sheet returning procedure (B) 75 (FIG. 2), the motor driver 55 (FIG. 2) allows the driving motors 61 and 62 to continue the rotation until the recording paper 110*a*, 110*b*, and 110*c* escape from the feed roller 13 and the retard roller 14. When the recording paper 110*a*, 110*b*, and 110*c* escape from the feed roller 13 and the retard roller 14, the sheet re-feeding procedure 76 is activated.

Figure 7:
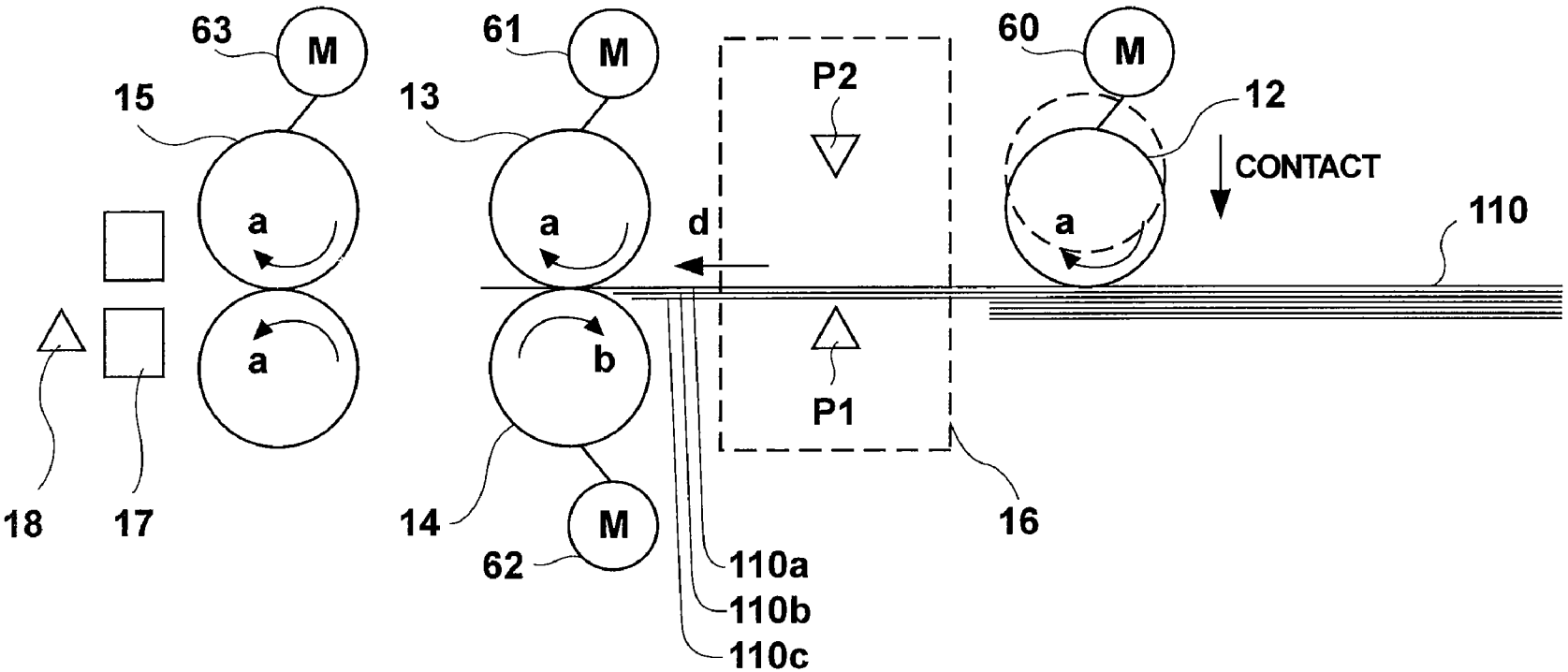
FIG. 7 is an explanatory diagram of a sheet re-feeding procedure in the embodiment 1.

FIG. 7 is an explanatory diagram of the sheet re-feeding procedure in the embodiment 1.

Step S1-8:

Under the control of the sheet re-feeding procedure 76 (FIG. 2), the pickup roller 12 is come into contact with the top one of the bundle of recording paper 110 enclosed in the paper feed cassette 11 (FIG. 1). At the same time, under the control of the sheet re-feeding procedure 76 (FIG. 2), the motor driver 55 (FIG. 2) forwardly rotates the driving motor 60, thereby rotating the pickup roller 12 in the direction of the arrow (a).

Step S1-9:

When the recording paper 110 is fed out by the pickup roller 12 and come into contact with the contact point P1 of the looseness detecting sensor 16, the motor driver 55 (FIG. 2) forwardly rotates the driving motor 61 under the control of the sheet re-feeding procedure 76 (FIG. 2), thereby rotating the feed roller 13 in the direction of the arrow (a). At the same time, the motor driver 55 (FIG. 2) reversely rotates the driving motor 62, thereby rotating the retard roller 14 in the direction of the arrow (b). Thus, the separating operation of the recording paper 110 fed out by the pickup roller 12 is executed. The recording paper 110*a* is conveyed in a conveying direction (d), the overlap-feed recovery operation is finished, and the control is returned to the normal medium feed control.

As described above, according to the medium feed control method of the embodiment, when the overlap-feed media are detected, the feed roller 13 and the retard roller 14 of different rotation speeds are allowed to continue the rotation in the directions of the arrows (a and b) until the upper and lower surfaces of the recording paper 110 as overlap-feed media are come into contact with the contact points P2 and P1 of the looseness detecting sensor 16, respectively, on the way of the medium returning procedure. In this instance, the rotation speed V13 of the feed roller 13 and the rotation speed V14 of the retard roller 14 are set so as to maintain the relation of (V13>V14). By this setting, the looseness is formed in each of the recording paper 110*a*, 110*b*, and 110*c*. Thus, the air layers are formed among the sheets of recording paper 110*a*, 110*b*, and 110*c* and such an effect that they are easily separated is obtained.

Embodiment 2

Although the upward looseness has been formed in the overlap-feed media by the looseness forming procedure in the embodiment 1, a process to further form a downward looseness is added in the embodiment 2. To accomplish such an object, a medium feed control method of the embodiment 2 is constructed as follows.

Figure 8:
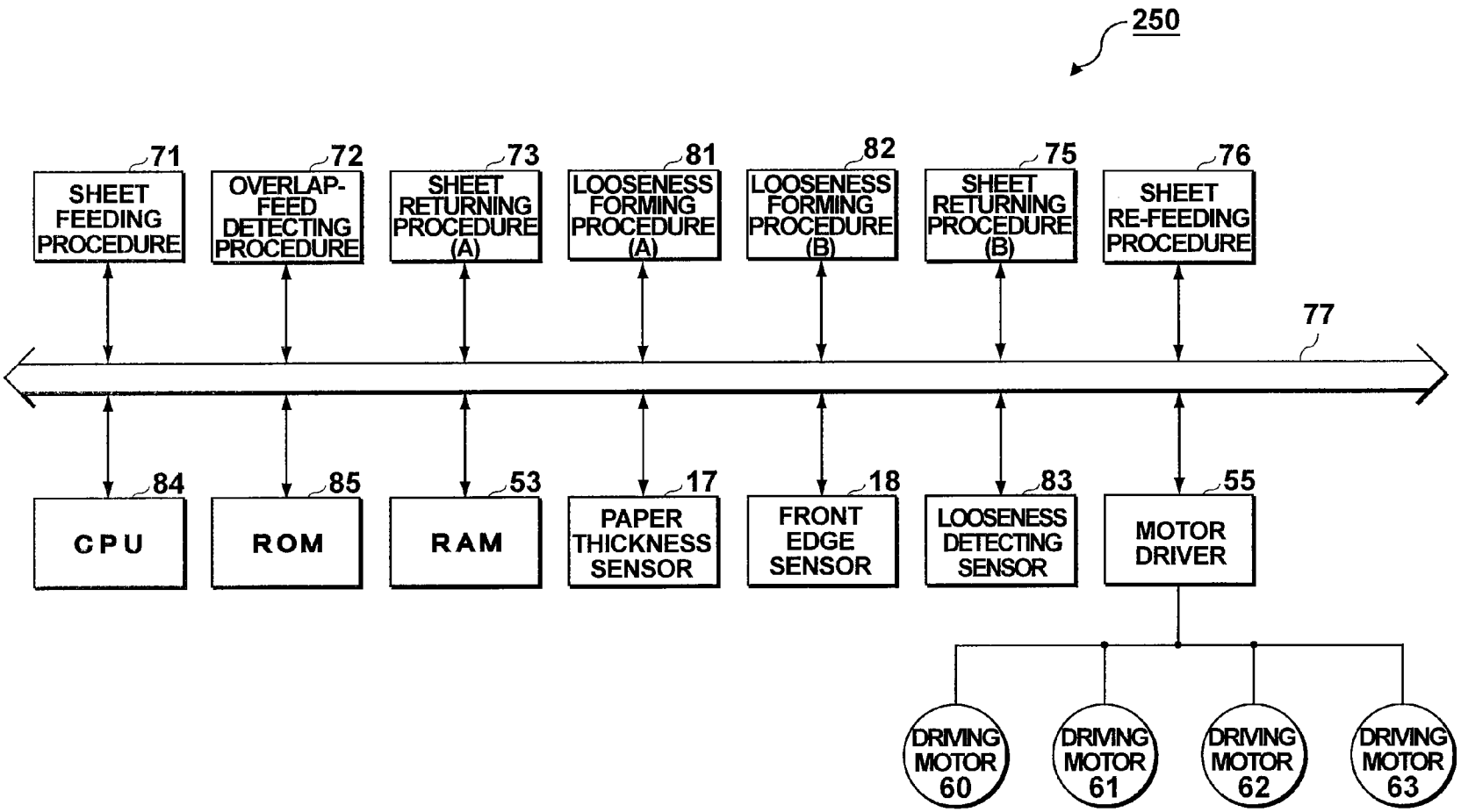
FIG. 8 is a block diagram showing a construction of medium feed control in the embodiment 2.

FIG. 8 is a block diagram showing a construction of medium feed control in the embodiment 2.

As shown in the diagram, a control unit 250 to execute the medium feed control in the image forming apparatus of the embodiment has: a CPU 84; a ROM 85; the RAM 53; a looseness detecting sensor 83; the paper thickness sensor 17; the front edge sensor 18; the motor driver 55; the sheet feeding procedure 71; the overlap-feed detecting procedure 72; the sheet returning procedure (A) 73; a looseness forming procedure (A) 81; a looseness forming procedure (B) 82; the sheet returning procedure (B) 75; the sheet re-feeding procedure 76; and the common bus 77. Only portions different from the embodiment 1 will be described in detail hereinbelow. Portions similar to those in the embodiment 1 are designated by the same reference numerals as those in the embodiment 1 and their overlapped explanation is omitted here.

The CPU 84 is a microprocessor to control the whole apparatus. In the embodiment, particularly, the CPU 84 is a portion for activating the sheet feeding procedure 71, overlap-feed detecting procedure 72, sheet returning procedure (A)

73, looseness forming procedure (A) 81, looseness forming procedure (B) 82, sheet returning procedure (B) 75, and sheet re-feeding procedure 76 by a method whereby the CPU 51 executes a predetermined control program which has previously been stored in the ROM 85.

The ROM 85 is a read only memory in which the control program for activating the sheet feeding procedure 71, overlap-feed detecting procedure 72, sheet returning procedure (A) 73, looseness forming procedure (A) 81, looseness forming procedure (B) 82, sheet returning procedure (B) 75, and sheet re-feeding procedure 76 by the method whereby the CPU 84 executes such a program has previously been stored. Control data necessary for the control has also previously been stored in the ROM 85.

The looseness detecting sensor 83 has three contact points. At the first contact point, the looseness detecting sensor 83 detects that the recording paper 110 has been supplied to the conveying path. At the second contact point, the looseness detecting sensor 83 detects an upward looseness of the recording paper 110 which is formed by the looseness forming procedure (A) 81, which will be explained hereinafter. At the third contact point, the looseness detecting sensor 83 detects a downward looseness of the recording paper 110 which is formed by the looseness forming procedure (B) 82, which will be explained hereinafter.

The sheet feeding procedure 71, overlap-feed detecting procedure 72, sheet returning procedure (A) 73, looseness forming procedure (A) 81, looseness forming procedure (B) 82, sheet returning procedure (B) 75, and sheet re-feeding procedure 76 are control procedures for the medium feed control in the embodiment 2 and are computer control procedures which are activated by the method whereby the CPU 84 executes the predetermined control program which has previously been stored in the ROM 85. The operation of the image forming apparatus of the embodiment 2 is limited only to the medium feed control method, divided into ten processing steps, and will be explained hereinbelow together with an explanation of each of the control procedures.

Figure 9:
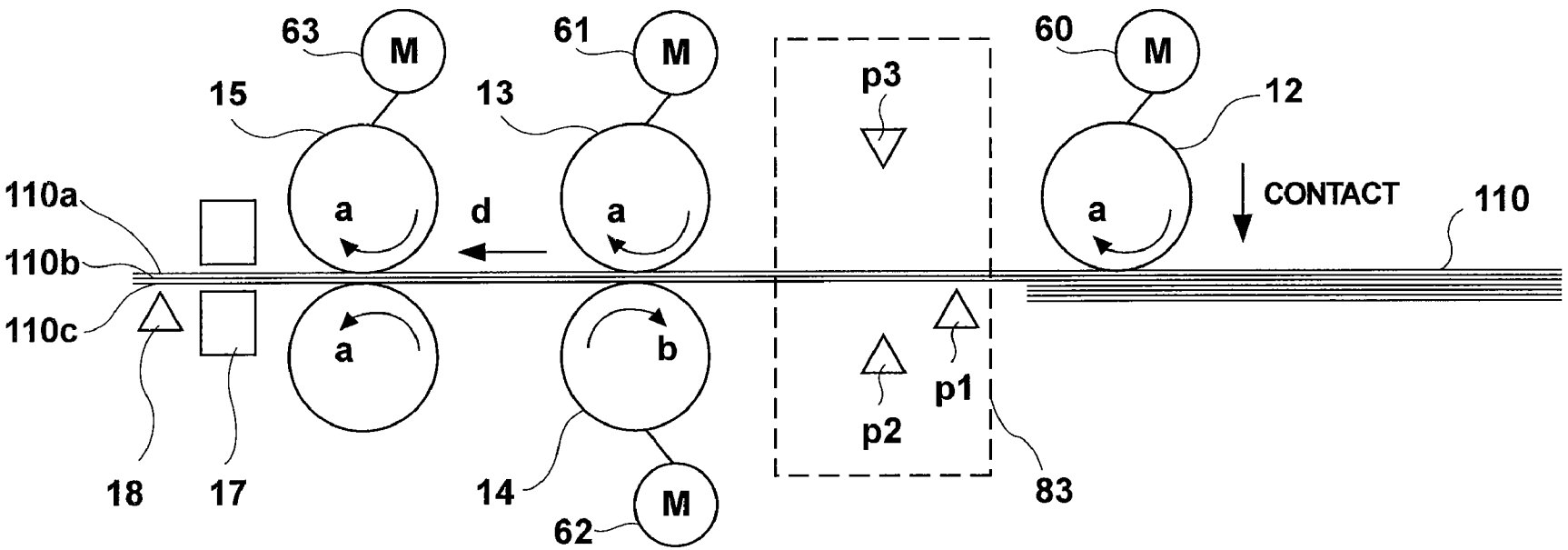
FIG. 9 is an explanatory diagram of a sheet feeding procedure and an overlap-feed detecting procedure in the embodiment 2.

FIG. 9 is an explanatory diagram of the sheet feeding procedure and the overlap-feed detecting procedure in the embodiment 2.

Step S2-1:

Under the control of the sheet feeding procedure 71 (FIG. 8), the pickup roller 12 is come into contact with a top one of the bundle of recording paper 110 enclosed in the paper feed cassette 11 (FIG. 1). At the same time, under the control of the sheet feeding procedure 71 (FIG. 8), the motor driver 55 (FIG. 8) forwardly rotates the driving motor 60, thereby rotating the pickup roller 12 in the direction of the arrow (a).

Step S2-2:

When the recording paper 110 is fed out by the pickup roller 12 and come into contact with a contact point p1 of the looseness detecting sensor 83, under the control of the sheet feeding procedure 71 (FIG. 8), the motor driver 55 (FIG. 8) forwardly rotates the driving motor 61, thereby rotating the feed roller 13 in the direction of the arrow (a). At the same time, the motor driver 55 (FIG. 8) reversely rotates the driving motor 62, thereby rotating the retard roller 14 in the direction of the arrow (b). Thus, the separating operation of the recording paper 110 fed out by the pickup roller 12 is executed.

Step S2-3:

After the advance of the front edge portion of the recording paper 110 was retarded in the nip portion of the resist roller pair 15 and the oblique motion of the paper was corrected, the motor driver 55 (FIG. 8) forwardly rotates the driving motor 63, thereby rotating the resist roller pair 15 in the direction of the arrow (a) and feeding the recording paper 110.

Step S2-4:

When the front edge portion of the recording paper 110 reaches the front edge sensor 18, the overlap-feed detecting procedure 72 (FIG. 8) is activated. Under the control of the overlap-feed detecting procedure 72 (FIG. 8), the motor driver 55 (FIG. 8) temporarily stops the driving motors 60, 61, 62, and 63. At this time, the overlap-feed detecting procedure 72 (FIG. 8) controls the paper thickness sensor 17 so as to measure the medium thickness $\alpha n$ of the recording paper 110. The overlap-feed detecting procedure 72 (FIG. 8) compares the medium thickness $\alpha n$ with the reference medium thickness $\alpha 0$ of the recording medium which has previously been stored in the ROM 85 (FIG. 8). If the value of $\alpha n$ is equal to or more than two times as large as the value of $\alpha 0$, it is determined that the overlap-feed has occurred. When this overlap-feed determination is made, the sheet returning procedure (A) 73 (FIG. 8) is activated.

Figure 10:
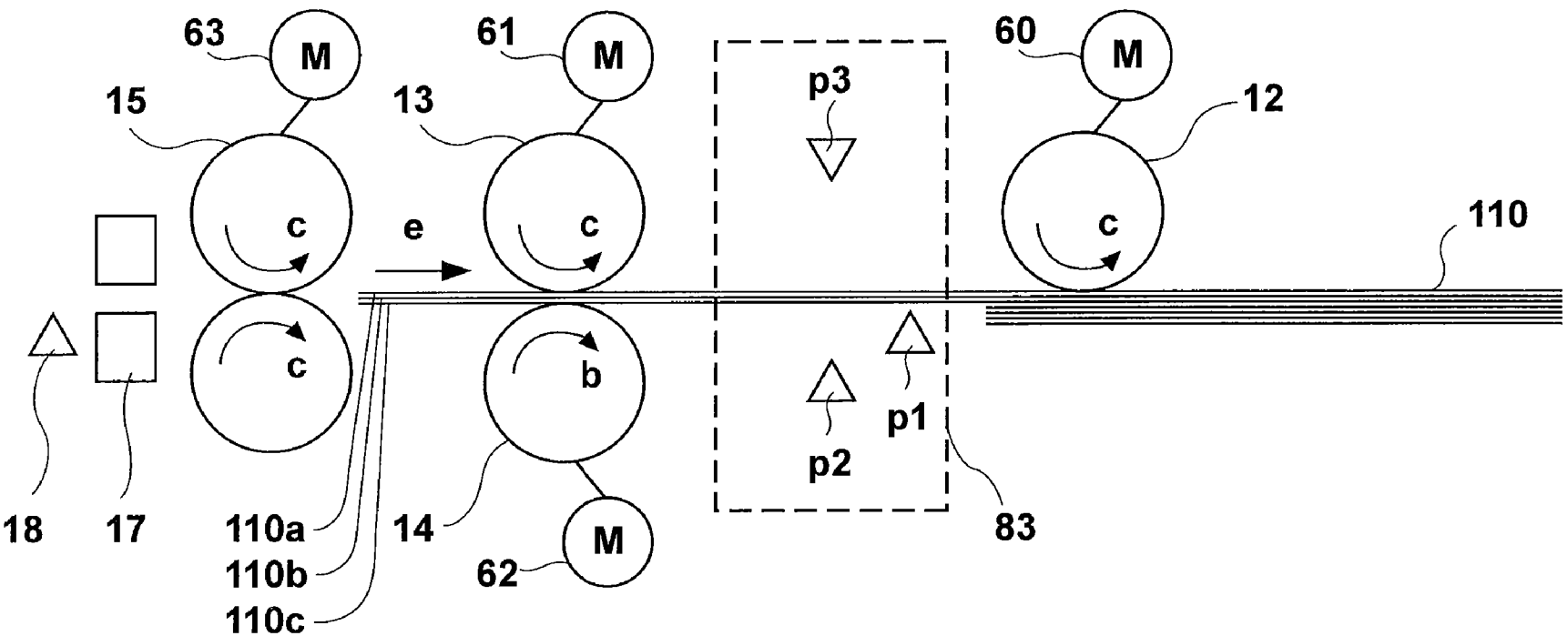
FIG. 10 is an explanatory diagram of a sheet returning procedure (A) in the embodiment 2.

FIG. 10 is an explanatory diagram of the sheet returning procedure (A) in the embodiment 2.

Step S2-5:

Under the control of the sheet returning procedure (A) 73 (FIG. 8), the sheets of recording paper 110 are returned in the direction of the arrow (e). To return the recording paper 110 in the direction of the arrow (e), under the control of the sheet returning procedure (A) 73 (FIG. 8), the motor driver 55 (FIG. 8) reversely rotates the driving motors 60, 61, 62, and 63. When the sheets of recording paper 110*a*, 110*b*, and 110*c* which are being overlap-fed escape from the resist roller pair 15, the looseness forming procedure (A) 81 (FIG. 8) is activated.

Figure 11:
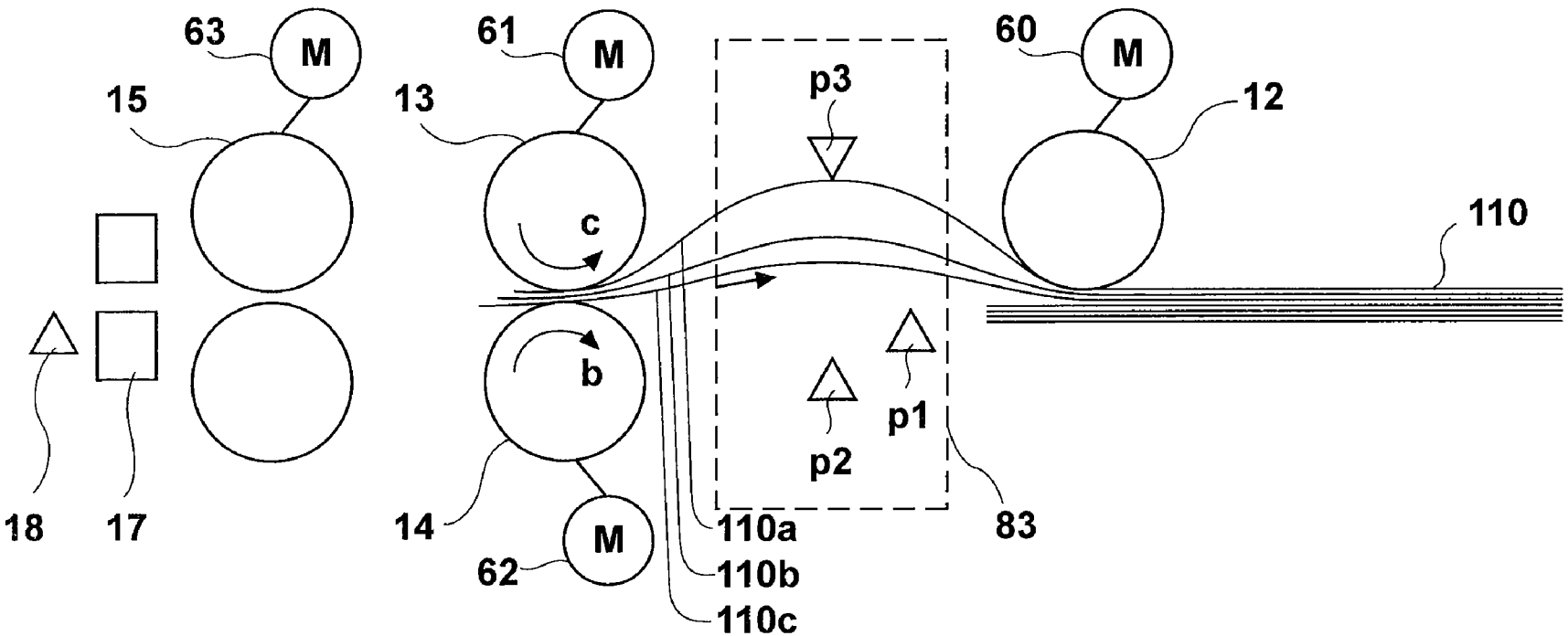
FIG. 11 is an explanatory diagram of a looseness forming procedure (A) in the embodiment 2.

FIG. 11 is an explanatory diagram of the looseness forming procedure (A) in the embodiment 2.

Step S2-6:

Under the control of the looseness forming procedure (A) 81 (FIG. 8), the motor driver 55 (FIG. 8) stops the driving motors 60 and 63, thereby stopping the pickup roller 12 and the resist roller pair 15. Under the control of the looseness forming procedure (A) 81 (FIG. 8), the motor driver 55 (FIG. 8) drives the driving motors 61 and 62, thereby allowing the feed roller 13 and the retard roller 14 to continue the rotation in the directions of the arrows (c and b) until the recording paper 110*a* is come into contact with a contact point p3 of 20 the looseness detecting sensor 83. In this instance, the rotation speed V13 of the feed roller 13 and the rotation speed V14 of the retard roller 14 are set so as to maintain the relation of (V13>V14). By this setting, a looseness is formed in the upper direction in each of the recording paper 110*a*, 110*b*, and 110*c* as shown in the diagram. Thus, air layers are formed among the sheets of recording paper 110*a*, 110*b*, and 110*c* and they are easily separated. When the recording paper 110*a* is come into contact with the contact point p3 of the looseness detecting sensor 83, the looseness forming procedure (B) 82 (FIG. 8) is activated.

Figure 12:
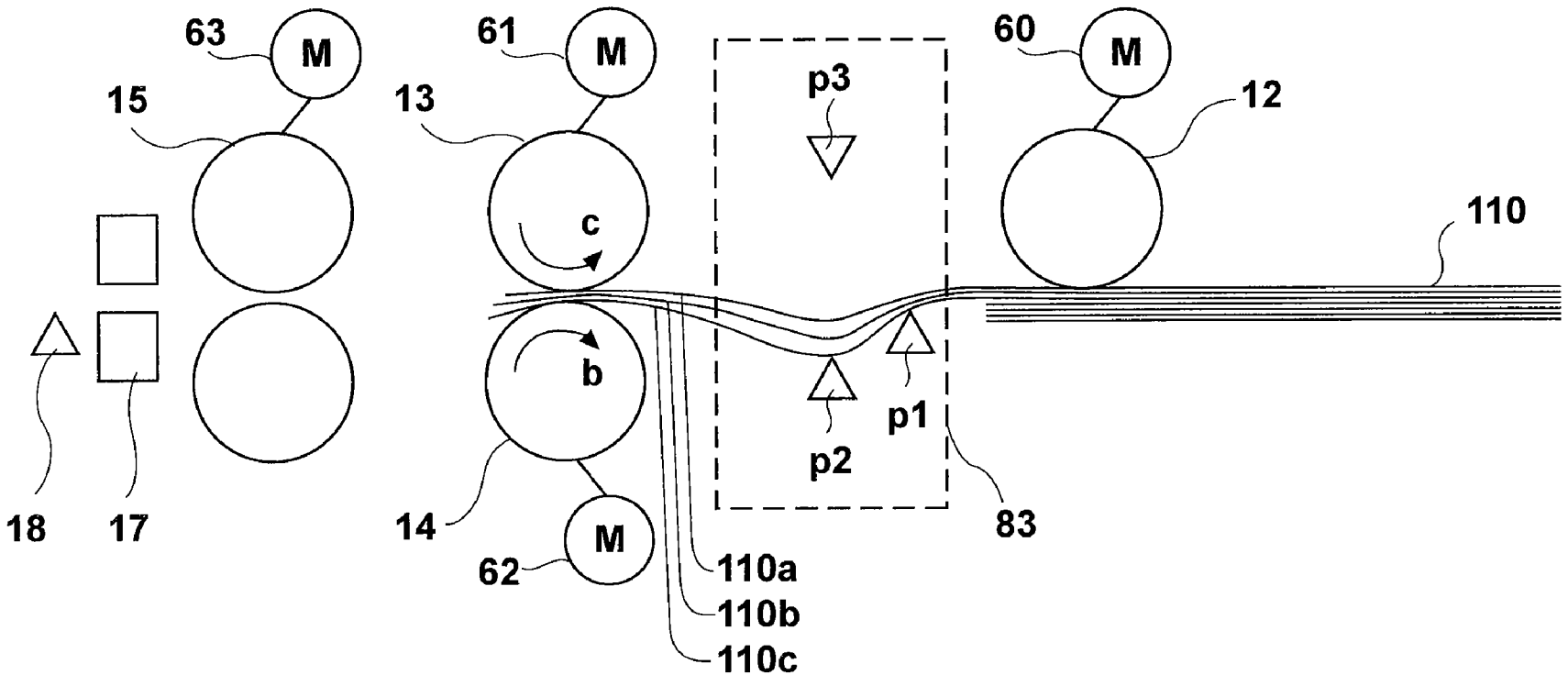
FIG. 12 is an explanatory diagram of a looseness forming procedure (B) in the embodiment 2.

FIG. 12 is an explanatory diagram of the looseness forming procedure (B) in the embodiment 2.

Step S2-7:

Under the control of the looseness forming procedure (B) 82 (FIG. 8), while the state where the driving motors 60 and 63 have been stopped, the motor driver 55 (FIG. 8) drives the driving motors 61 and 62, thereby allowing the feed roller 13 and the retard roller 14 to continue the rotation in the directions of the arrows (c and b) until the recording paper 110*a* is come into contact with a contact point p2 of the looseness detecting sensor 83. In this instance, the rotation speed V13 of the feed roller 13 and the rotation speed V14 of the retard roller 14 are set so as to maintain a relation of (V13<V14). By this setting, a looseness is formed in the lower direction in each of the recording paper 110*a,* 110*b,* and 110*c* as shown in the diagram. Thus, air layers are formed among the sheets of recording paper 110*a,* 110*b,* and 110*c* and they are easily separated. When the recording paper 110*a* is come into contact with the contact point p2 of the looseness detecting sensor 83, the sheet returning procedure (B) 75 is activated.

Figure 13:
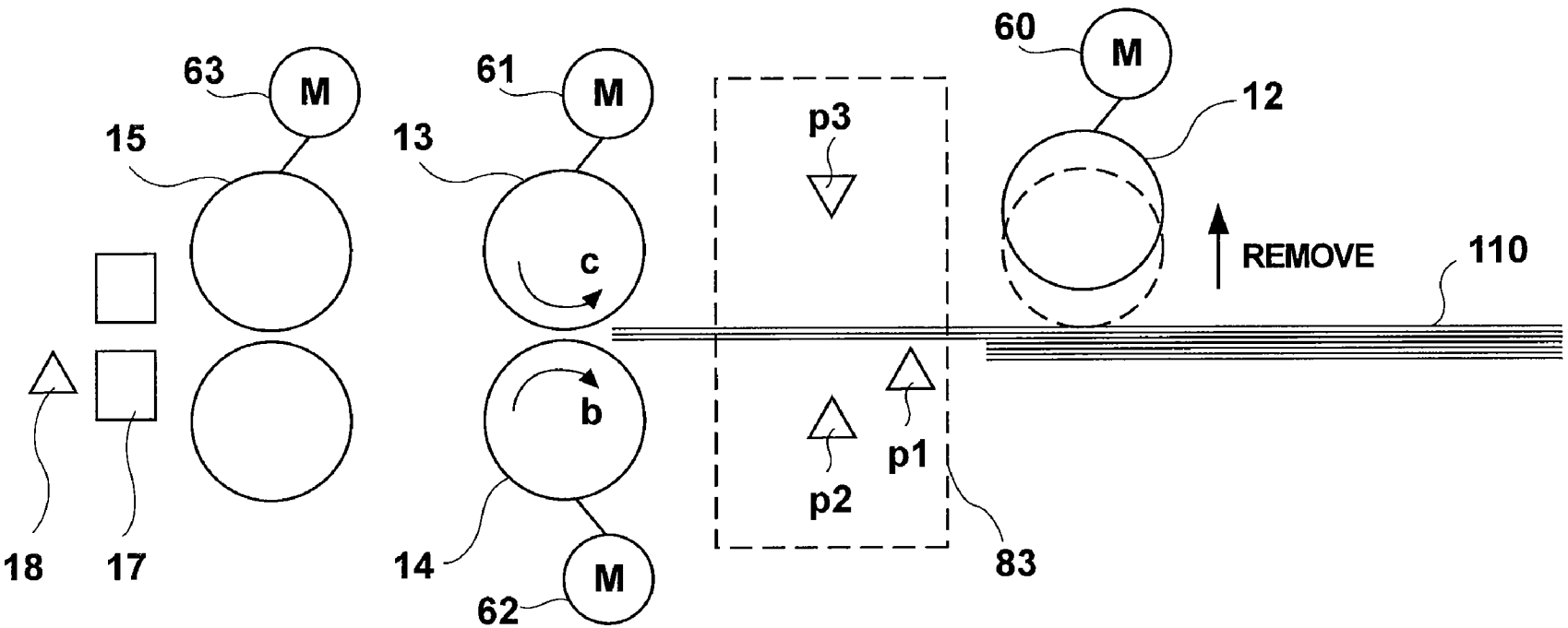
FIG. 13 is an explanatory diagram of a sheet returning procedure (B) in the embodiment 2.

FIG. 13 is an explanatory diagram of the sheet returning procedure (B) in the embodiment 2

Step S2-8:

Under the control of the sheet returning procedure (B) 75 (FIG. 8), the pickup roller 12 is removed from the top one of the bundle of recording paper 110 enclosed in the paper feed cassette 11 (FIG. 1). Under the control of the sheet returning procedure (B) 75 (FIG. 8), the motor driver 55 (FIG. 8) allows the driving motors 61 and 62 to continue the rotation until the recording paper 110*a,* 110*b,* and 110*c* escape from the feed roller 13 and the retard roller 14. When the recording paper 110*a,* 110*b,* and 110*c* escape from the feed roller 13 and the retard roller 14, the sheet re-feeding procedure 76 is activated.

Figure 14:
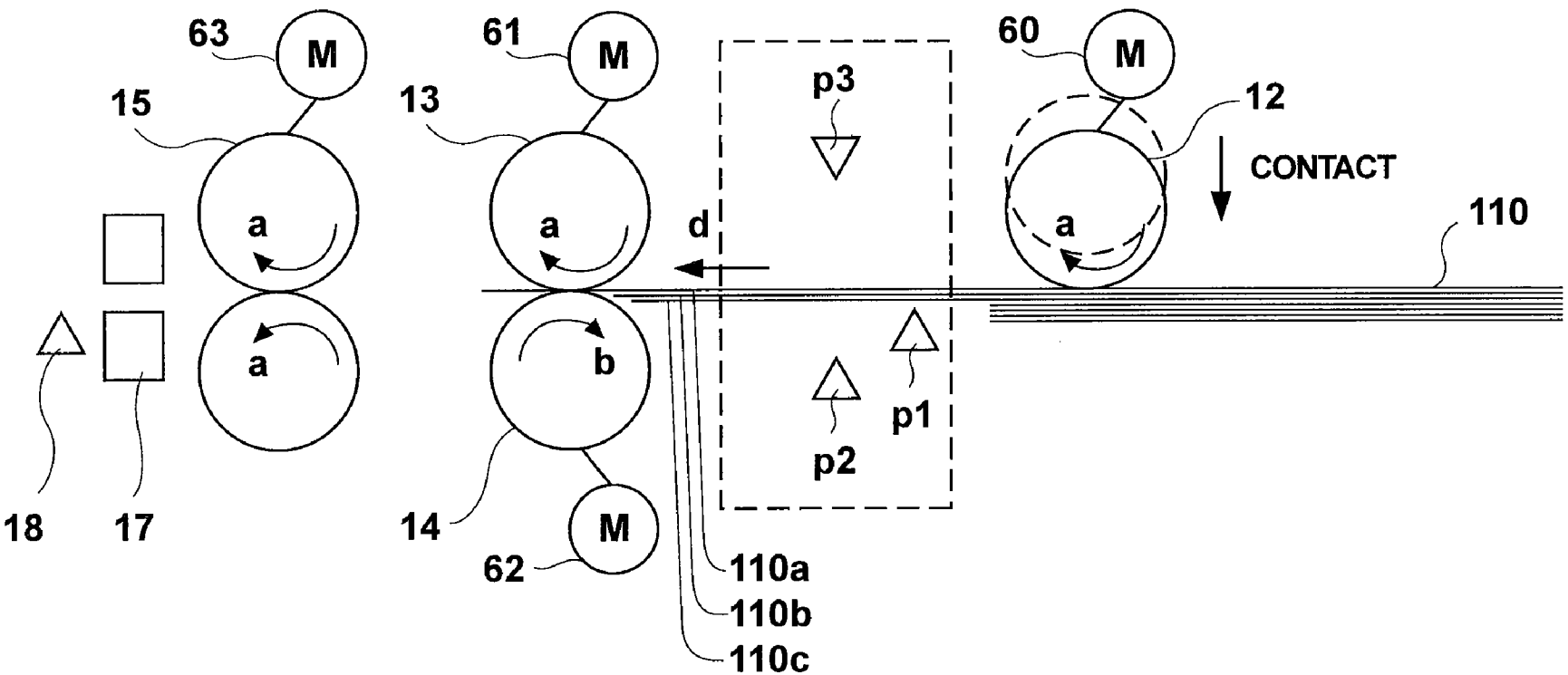
FIG. 14 is an explanatory diagram of a sheet re-feeding procedure in the embodiment 2.

FIG. 14 is an explanatory diagram of the sheet re-feeding procedure in the embodiment 2.

Step S2-9:

Under the control of the sheet re-feeding procedure 76 (FIG. 8), the pickup roller 12 is come into contact with the top one of the bundle of recording paper 110 enclosed in the paper feed cassette 11 (FIG. 1). At the same time, under the control of the sheet re-feeding procedure 76 (FIG. 8), the motor driver 55 (FIG. 8) forwardly rotates the driving motor 60, thereby rotating the pickup roller 12 in the direction of the arrow (a).

Step S2-10:

When the recording paper 110 is fed out by the pickup roller 12 and come into contact with the contact point p1 of the looseness detecting sensor 16, the motor driver 55 (FIG. 8) forwardly rotates the driving motor 61 under the control of the sheet re-feeding procedure 76 (FIG. 8), thereby rotating the feed roller 13 in the direction of the arrow (a). At the same time, the motor driver 55 (FIG. 8) reversely rotates the driving motor 62, thereby rotating the retard roller 14 in the direction of the arrow (b). Thus, the separating operation of the recording paper 110 fed out by the pickup roller 12 is executed. The recording paper 110*a* is conveyed in the conveying direction (d), the overlap-feed recovery operation is finished, and the control is returned to the normal medium feed control.

As described above, according to the medium feed control method of the embodiment 2, by adding the downward looseness forming procedure (B) to the upward looseness forming procedure (A) (corresponding to that in the embodiment 1), such an effect that the overlap-feed recovery can be further certainly executed is obtained. By repeating steps S2-6 and S2-7 a plurality of number of times, such an effect that that the overlap-feed recovery can be further certainly executed is obtained.

Although the embodiments have been described above with respect to the case where the invention is applied to a printer, the invention is not limited to such examples. That is, the invention can be also applied to other apparatuses such as facsimile apparatus, copying apparatus, and the like.

It should be understood by those skilled in the art that various modifications, combinations, sub-combinations and alterations may occur depending on design requirements and other factors insofar as they are within the scope of the appended claims or the equivalents thereof.

What is claimed is:

1. A medium feed control method of preventing an overlap-feed of recording media, comprising:

a medium feeding step wherein said recording media are supplied from a medium enclosing portion to a medium conveying path;

an overlap-feed detecting step wherein a thickness of said recording media which are supplied to said medium conveying path in said medium feeding step is monitored, for detecting overlap-feed media;

a medium returning step wherein the overlap-feed media are returned to said medium enclosing portion when said overlap-feed media are detected in said overlap-feed detecting step;

a medium separating step that includes the steps of:

applying different returning forces respectively to upper and lower surfaces of said overlap-feed media on the way of said medium returning step to separate said overlap-feed media, limiting movement of one of the overlap-feed media as the overlap-feed media moves toward the medium enclosing portion, detecting a separation of the overlap-feed media, and releasing the limiting movement of one of the overlap-feed media after the separation of the overlap-feed media is detected; and a medium re-feeding step wherein said recording media returned in said medium returning step are supplied again to said medium conveying path from said medium enclosing portion.

2. The medium feed control method according to claim 1, wherein the medium separating step further includes the step forming an air layer between the layers of the overlap-feed media.

3. The medium feed control method according to claim 1, wherein the different returning forces are generated by rotating a feed roller and a retard roller in opposite directions.

4. The medium feed control method according to claim 1, wherein in said medium separating step, said returning forces applied to the upper and lower surfaces of said overlap-feed media are controlled, and said medium separating step includes a step to heighten one of said returning forces with respect to another of said returning forces and a step to lower the one of said returning forces with respect to the another of said returning forces.

5. The medium feed control method according to claim 1, wherein in the medium separating step, a looseness is formed in each of the overlap-feed media by returning the overlap-feed media to the medium enclosing portion.

6. The medium feed control method according to claim 5, wherein in the medium re-feeding step, after being separated from the returned overlap-feed media, the feed member is contacted with the recording media when the recording media are supplied from the medium enclosing portion to the medium conveying path.

7. The medium feed control method according to claim 1, wherein in the medium returning step, a rotation speed of the first conveyance member in the reverse direction and a rotation speed of the second conveyance member in the reverse direction are set to be different.

* * * * *